United States Patent [19]

Pajares

[11] Patent Number: 4,899,723

[45] Date of Patent: Feb. 13, 1990

[54] COMBINATION GAS AND ELECTRIC STOVE WITH BURNER ARRANGEMENT THEREFOR

[75] Inventor: Luis R. Pajares, Trujillo, Peru

[73] Assignee: Industrias Fenix S.A., Trujillo, Peru

[21] Appl. No.: 365,834

[22] Filed: Jun. 14, 1989

[51] Int. Cl.[4] ..... F24C 3/00; F27D 11/00

[52] U.S. Cl. ..... 126/39 R; 126/39 BA; 219/279

[58] Field of Search ..... 126/39 R, 39 BA, 39 E, 126/39 H, 9 R, 9 B, 37 R, 39 C; 219/279, 443, 280

[56] References Cited

U.S. PATENT DOCUMENTS

| | | | |
|---|---|---|---|
| 1,716,329 | 6/1929 | Simpson | 219/279 |
| 2,148,407 | 2/1939 | Pierson | 219/443 X |
| 2,658,987 | 11/1953 | Ogden | 126/39 H |
| 3,186,472 | 6/1965 | Caravella | 126/39 H |
| 3,230,947 | 1/1966 | Finnstrand | 219/279 X |
| 4,524,751 | 6/1985 | Hoglund | 219/279 X |

*Primary Examiner*—Larry Jones

*Attorney, Agent, or Firm*—George J. Netter

[57] ABSTRACT

A cooking and heating stove capable of operating on either gaseous fuel or electricity has a combination burner construction consisting of an annular metal plate with an electrical resistance heater located in recessed grooves on the undersurface, and a ceramic gas distributor int he central opening of the plate. Separate controls on a common housing are provided for the gas and electrical parts of the burner assembly.

4 Claims, 2 Drawing Sheets

COMBINATION GAS AND ELECTRIC STOVE WITH BURNER ARRANGEMENT THEREFOR

The present invention relates generally to a stove used for cooking, heating or the like, and, more particularly, to such a stove which is selectively operable on either gas or electricity and a special burner arrangement therefor.

BACKGROUND OF THE INVENTION

Typically, heating and cooking stoves are operated solely either by natural gas, bottled gas, oil products or electricity, the two major fuel sources being gas and electricity. However, there are many situations that occur, such as a natural disaster, for example, in which the supply of any one or more of the fuels may be interrupted for a substantial period of time such that cooking and heating cannot be produced on stoves which are dedicated strictly to the particular missing fuel.

It is, therefore, accordingly desirable to be able to have a stove apparatus which can operate optionally on either electricity or gas such that in the event of inability to obtain one of the fuels, the stove apparatus can still be operated on the available fuel. Also, stove apparatus which can operate on more than one fuel, can follow fuel price changes to advantage since the use cost of electricity and gas rarely will be identical.

SUMMARY OF THE INVENTION

In accordance with the present invention there is provided stove apparatus for either cooking or heating which is selectively operable on either a gas fuel or electricity. A combination burner assembly is utilized for either and includes a generally circular plate of iron having a central opening therethrough. Surrounding the opening is a downwardly extending flange which passes through a similar opening in the top of a stove housing and is received over a gas inlet conduit. A ceramic loose fitting plug or cover is positioned within the iron plate opening and includes on its lower surface a plurality of grooves which serve to direct the gas upwardly and fanned out 360 degree arrangement such that when lit it provides a circular ring of flame.

The undersurface of the iron plate has a spiral set of grooves within which are received electrical heating elements such as a nickel chrome conductors enclosed within a suitable insulative carbon and silicon covering.

The stove apparatus housing includes two sets of controls, one for electrical operation and one for gas.

DESCRIPTION OF A PREFERRED EMBODIMENT

Figure 1:
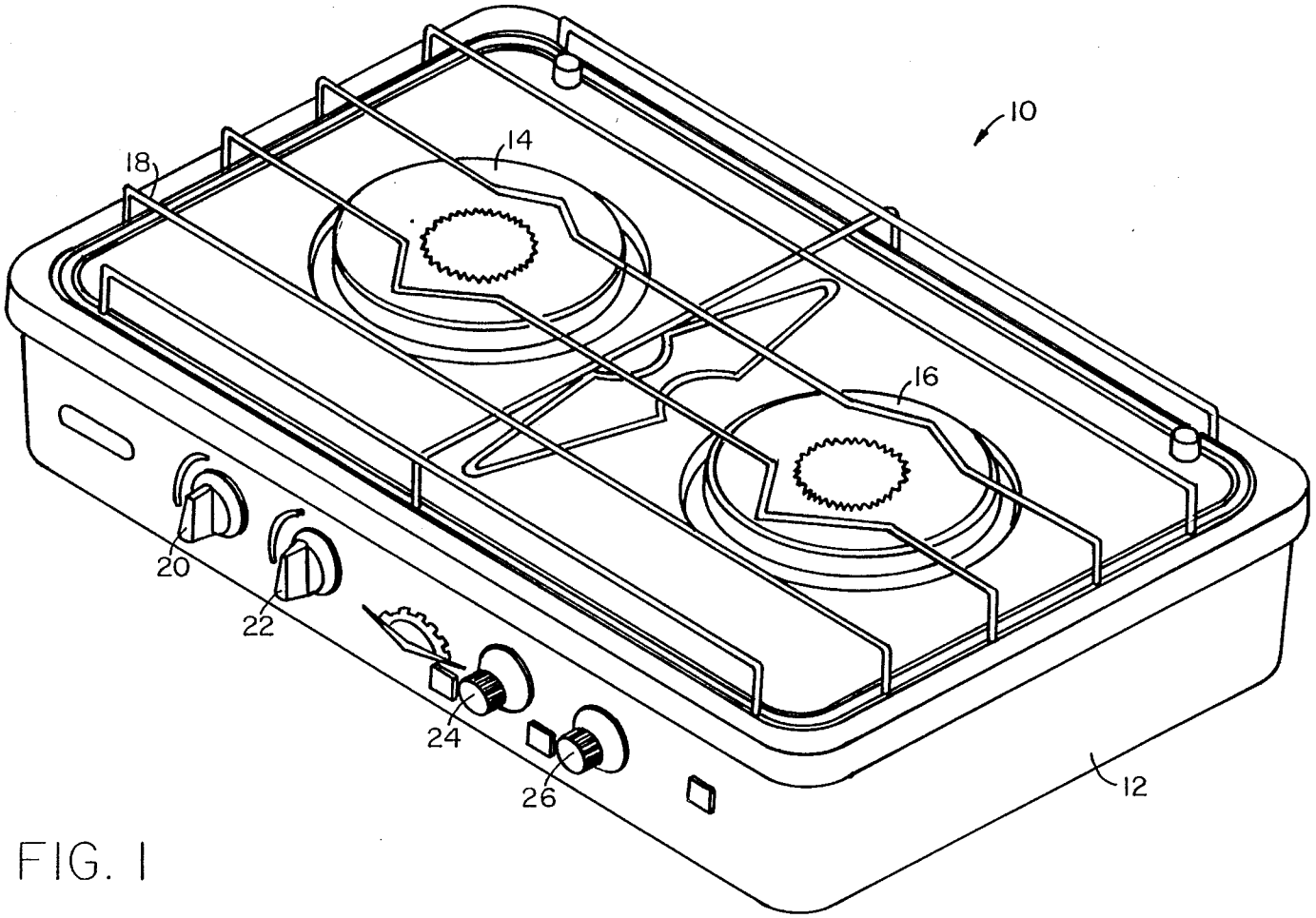
FIG. 1 is a perspective view of the stove apparatus of this invention.

Turning now to the drawings and particularly FIG. 1, the stove apparatus of the invention is identified generally as 10 and is seen to consist generally of a housing 12 with a top flat horizontal surface on which there are first and second burner assemblies 14 and 16 and over which there is located rack 18 for supporting cooking utensils and the like during use.

On a front side panel are included first and second hand operated gas controls 20 and 22 for controlling in a conventional manner gas applied to the burner assemblies 14 and 16, respectively. On the same panel there are provided also first and second electrical control knobs 24 and 26 for controlling electrical heating of the same burner assemblies 14 and 16. Although the device shown is of a portable type and only has two burners, it is contemplated to be within the spirit of the invention to have such stove apparatus including one, two, three or four burners and it can be either portable or built for fixed positioning, as desired.

Figure 2:
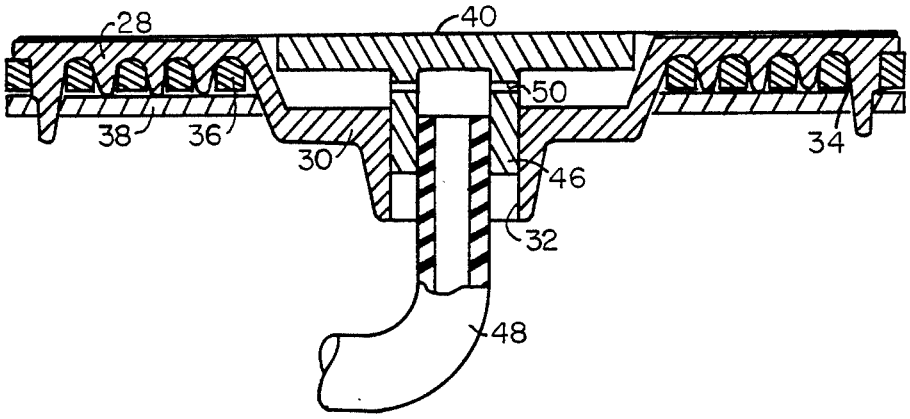
FIG. 2 is a side elevational sectional view taken through the combination burner arrangement along lines 2—2 of FIG. 1.

Turning now to FIG. 2, the combination burner arrangement is depicted generally therein and is seen to consist generally of a cast iron or steel plate 28 circular in its outer geometry with a substantially depressed circular center portion 30 and a central opening 32. The lower surface of the plate 28 lying outwardly of the depressed portion 30, is formed into a continuous spiral groove 34 within which is received a similarly shaped length of electrical heating element 36. A protective cap plate 38 (e.g., sheet metal) is secured over the bottom surface of the plate and spiral groove and has a geometry substantially identical to that of the plate.

A gas distribution element 40 has a generally circular top plate, the edges of which are serrated at 42 and a central cylindrical fitting 46 which is received over the end of a supply gas pipe 48. The top surface of the gas distribution element substantially coincides with the top surface of the plate.

In use, gas from the pipe 48 passes along cylindrical fitting 46, exits through openings 50 underneath the circular top surface of the element 40 and is distributed evenly along the serrated edges for burning.

For electrical heating, an electric current passing through the elements 36 produces heat in a way well known in the art to heat up the plate 28 for cooking or heating.

Separate control for the providing heating by either gas or electricity is achieved by manipulation of the gas controls 20 and 22, or electrical controls 24 and 26, as the case may be.

There is provided in accordance with the present invention, a stove for heating or cooking utilizing either gaseous fuel or electrical power as the energy source. For the utilization of gas, it may be directly connected to a natural gas supply fitting, or, optionally, it can be interconnected via suitable conduiting to a bottled gas source. The electrical interconnections to the heating elements 36 are not shown since they are conventional and consist generally of ceramic members with appropriate included male or female connection means.

What is claimed is:

1. Stove apparatus operable on either gas or electricity, comprising:

a housing;

a burner assembly mounted on a horizontal outer surface of the housing including, a metal plate having a central opening, a depressed portion surrounding the central opening, and a spiral groove on a major surface, an electrical heating element lying in the spiral groove, a protective metal sheet covering the groove and heating element, a gas distributer having a platelike top with serrated edge and a hollow central fitting slidingly received within the metal plate opening and connected to a gas source pipe; and separate gas and electric controls mounted on a side surface of the housing.

2. Stove apparatus as in claim 1, in which the metal plate is constructed of cast iron.

3. Stove apparatus as in claim 1, in which the metal plate is constructed of steel.

4. Stove apparatus as in claim 1, in which the gas distributor is constructed of a ceramic material.

* * * * *